US007725974B2

(12) United States Patent
Hughes

(10) Patent No.: US 7,725,974 B2
(45) Date of Patent: Jun. 1, 2010

(54) SHOE AND FOOT CLEANING AND DISINFECTING SYSTEM

(76) Inventor: Randall L. Hughes, 3916 Daisy Pl., Oceanside, CA (US) 92056

( * ) Notice: Subject to any disclaimer, the term of this patent is extended or adjusted under 35 U.S.C. 154(b) by 868 days.

(21) Appl. No.: 11/592,437

(22) Filed: Nov. 2, 2006

(65) Prior Publication Data

US 2008/0104782 A1 May 8, 2008

(51) Int. Cl.
*A47C 12/02* (2006.01)

(52) U.S. Cl. ..... 15/30; 15/21.1; 15/104.92

(58) Field of Classification Search ..... 15/104.92, 15/161, 160, 36, 37, 21.1, 30; *A47C 23/00, A47C 23/02*

See application file for complete search history.

(56) References Cited

U.S. PATENT DOCUMENTS 3,649,994 A * 3/1972 Harris ..... 15/311
4,425,677 A 1/1984 Cox
4,922,578 A 5/1990 Miettinen
5,950,269 A 9/1999 Openshaw et al.
6,557,203 B2 5/2003 Meshbesher
6,584,636 B2 7/2003 Schlem

* cited by examiner

*Primary Examiner*—Monica S Carter
*Assistant Examiner*—Stephanie Newton
(74) *Attorney, Agent, or Firm*—Donn K. Harms

(57) ABSTRACT

A cleaning and disinfecting system for the cleaning and disinfecting of footwear or feet. The system provides for cleaning and disinfecting the bottom of the feet or footwear. An optional brush on a wand provides cleaning to upper foot areas as required. The system is automatically activated only when a person stands on the device, thereby minimizing the volume of fluid required to perform the process. Optionally, a venturi component allows the addition of a cleaning or disinfecting fluid with the cleaning solution or water. When the system is attached to a hot water line and fitted with heating elements, it can be used to remove snow from shoes and boots.

19 Claims, 6 Drawing Sheets

SHOE AND FOOT CLEANING AND DISINFECTING SYSTEM

FIELD OF THE INVENTION

This invention deals with the cleaning of feet and footwear. More particularly, the disclosed system provides the capability to clean and disinfect the bottom of the feet or footwear while also offering a brush on a wand to clean and disinfect the upper areas as required. When the system is attached to a hot water line and fitted with heating elements, it can be used to remove snow and ice from shoes and boots prior to entry into a home or business.

BACKGROUND OF THE INVENTION

When entering residences and commercial venues, there is an ever growing need to clean the feet of residents and visitors. Occupants of residences continually need to make sure that visitors' and residents' feet and shoes are clean before entering to prevent dirty carpets and flooring. The same holds true with many commercial venues, especially commercial livestock and agriculture enterprises which are subject to diseases that can be transmitted to the livestock or plants by visitors.

Additionally, there is a growing need for people to become more aware of their own and visitors' personal hygiene. We are constantly reminded of how important it is to wash our hands as often as possible, and with the advent of impending pandemic problems, such as Avian Flu, people must also be aware of their wearing apparel and especially their footwear. Too often, the waters at our beaches are so contaminated that a warning is given against entering the water which is bacteria or debris laden and can make swimmers sick. Walking on the same beach, even if entering the water is avoided, will still impart bacteria from the water to the feet or footwear. Additionally, in agriculture and farming, a person walking on a farm that has a diseased animal or crop can contract bacteria, viruses, or plant diseases to their feet or footwear which can easily be transported to another farm or agriculture venue by the infected person. Thus, it has become apparent that diseases can be transmitted equally by our feet as well as by our hands. Consequently, cleaning and disinfecting our feet as well as our footwear is vitally important.

For those adults and children wading in the waters at the beach rinsing off the sand with fresh water may not be adequate. One of the most effective and economical disinfecting fluids is the chlorine bleach used for washing clothes in a dilute with water.

In farming and agriculture, workers in the agricultural field are constantly walking in fertilizers and insecticides, which cling to their feet and can impregnate their footwear. Working with animals creates additional problems where individuals are required to walk through fresh feces that can cling to their footwear. A paramount occurrence which has made people more aware of this problem has been the recent headlines regarding Avian Flu and the potential disasters that it may cause a human pandemic in addition to the millions of bird deaths. The poultry industry has been greatly affected by this potential problem.

A simple mixture of disinfectant washed over the feet and/or footwear of workers and visitors to farms, greenhouses, and animal raising venues can remove germs, viruses, and other contaminants before they are transported. Further, if every farm and agriculture venue required visitors and workers to clean footwear before entering and on leaving, the transport of such contaminants from one farm to another can be eliminated or significantly reduced.

Unlike many Eastern cultures, Americans are not accustomed to removing their shoes before entering homes, offices, medical facilities, etc. A quick wipe on a doormat will only clean so much and has no disinfecting capabilities, leaving the floors and carpets to absorb what is left on the soles of the shoes or from the bare feet. The door mat itself can become a central point in actually infecting visitors since numerous visitors actually wipe their feet and leave germs, viruses and the like on the mat for the next person to encounter. Vacuuming the carpets where children often play cannot adequately remove all the bacteria, germs, and dirt which the mat misses and which can filter deep into the floor coverings. Because of this lack of hygiene on entry to homes and businesses, to be fully protected floors must be mopped with a disinfectant and carpets steam cleaned often to kill or remove contaminants missed at the door. In medical facilities shoe coverings are worn in operating rooms, but in moving around the hospital from room to room medical personnel have the potential of carrying infectious materials from one place to another on their shoes.

While the prior patents and prior art systems have been successful to a certain extent, it is nonetheless clear that substantial room exists for affecting an advance in the art which overcomes these shortcomings in a practical and efficient manner. Recent health issues have made the field of cleanliness and disinfecting a very high priority in the minds of most people.

REFERENCES SITED

More recently, U.S. Pat. No. 4,425,677 of James P. Cox presented a shoe cleaner for removing debris from the sole of a shoe that is comprised of a foraminous scraper for contacting the sole of a shoe and, upon relative motion therebetween, removing debris therefrom and a wick member for applying a liquid deodorant and/or solvent for the debris to the shoe from a reservoir proximate to the foraminous scraper. The shoe cleaner disclosed herein also preferably includes a mat for removal of any excess deodorant and/or solvent and for secondary removal of debris from the sole of the shoe.

This patent describes a shoe cleaner for removing debris from the sole of a shoe. The system could only be for minimal usage because the wicking system will retain bacteria the same as a sponge and will require frequent cleaning. Any deodorant or disinfectant would be depleted after just a few uses.

U.S. Pat. No. 4,922,578 of Veli V. A. Miettinen describes a shoe sole cleaner comprising a power section and a brush section. The brush section is essentially planelike and it includes brush rods. The power section and the brush section are placed at a distance from each other. The power section is provided with a fluid power supply. The brush section includes a vibrating member such as a piston in a piston and cylinder combination. The fluid power supply is connected to the vibrating member by a fluid transmission means such as a pipe. The vibrating member is in contact with the brush rods and by means of the vibrating member the brush rods are made to move in a desired back and forth motion. The shoe sole cleaner according to the invention is low in construction so that it fits in the place of ordinary doormats. The cleaner can be extended simply by connecting several similar brush sections together as a large shoe sole cleaner.

This patent describes a shoe sole cleaner comprising a power section and a brush section that would not be usable on bare feet and would require frequent cleaning. The system does not supply a means to clean the upper area of the shoe.

U.S. Pat. No. 5,950,269 of Deryl E. Openshaw et al. teaches of a sole cleaning device for cleaning the bottoms and sides of the soles of boots and shoes including a rotating brush mounted above a container of water so that upon rotation of the brush a portion of the brush extends into the water. The device further includes a removable scraper grate for supporting a shoe above the water but in engagement with the brush. A motor for rotating the brush against the sole of the boot. The removable grate is provided with a pair of spaced and parallel side rails having fixed brushes mounted to the side rails and facing one another. The removable grate further includes a sieve platform extending on one side of the grate above the water. Sponges are positioned on top of the sieve for removing water from a boot or shoe placed on the sponge.

This patent teaches of a sole cleaning device for cleaning the bottoms and sides of the soles of boots that uses a rotating brush that could not be used on bare feet and uses sponges to remove water. It is a fact that sponges retain bacteria and would require frequent replacement. The device has brushes to clean the sole and sides but does not supply a means to clean the upper area of the footwear.

U.S. Pat. No. 6,557,203 of Irwin B. Meshbesher discloses an apparatus for cleaning and sanitizing footwear including a container for disinfectant liquids which has an upwardly open U-shaped channel tack-welded to the bottom panel of the container in which channel at least one brush is removably attached. The brush is adapted to remove debris from the bottom of footwear while a pair of inwardly facing brushes are provided for cleaning the sides of the footwear. Preferably, a scraper blade is attached to one end panel of the container. Outwardly extending flanges are provided on opposed surfaces of the container for manual grasping and lifting of the system. Optionally, a pair of laterally extending L-shaped brackets attached to opposite sides of the container are provided for stabilizing the system during use.

This patent discloses an apparatus for cleaning and sanitizing footwear consisting of a container for disinfecting liquids with brushes with which a person moves their foot back and forth. This device will also require frequent cleaning and replacing the fluids and does not offer a means to clean and disinfect the upper area of the shoe.

U.S. Pat. No. 6,584,636 of Jon E. Schlem describes a footwear cleaning apparatus that includes a vertically oriented frame with an upper frame for supporting the user that is standing while cleaning the footwear. The apparatus receives water from a garden hose and provides a control valve for regulating the water flow while the user is standing upright. The water is directed upwardly through a foot platform on the lower frame and through a lower brush onto the footwear sole, the resulting splash causing water to wet two side brushes that are oriented to bear upon the sides of the footwear. A scraper assembly is also on the lower frame and provides a horizontal scraping edge and two vertical scraping edges for the sole and sides of the footwear, respectively. After the water is turned off, a drain outlet allows the system to be drained.

The Schlem device teaches a footwear cleaning apparatus with brushes that attach to a garden hose with a scraper. This device would not be easily used on bare feet and does not supply a means to clean the upper area of the footwear.

None of these previous efforts provide the benefits attendant with the present invention. The present invention achieves its intended purposes, objects and advantages over the prior art devices through a new, useful and unobvious combination of method steps and component elements with the use of a minimum number of functioning parts, at a reasonable cost to manufacture, and by employing readily available materials.

In this respect, before explaining at least one embodiment of the invention in detail it is to be understood that the invention is not limited in its application to the details of construction and to the arrangement, of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent construction insofar as they do not depart from the spirit and scope of the present invention.

OBJECTS OF THE INVENTION

It is a general object of this invention to supply a multipurpose shoe and foot cleaning and disinfecting system to be used in a variety of applications.

It is a further general object of the invention to supply a system that can clean and disinfect the bottom, sides and top of footwear or feet including up the legs if required.

Another object of this invention is to create a means to minimize the amount of fluid required to perform such a cleaning and disinfecting operation.

Yet another object of this invention is to supply a system that will automatically activate when a person steps on the cleaning and disinfecting surface and deactivate when the person steps off.

Another object of this invention is to supply a system that does not require frequent cleaning and replacement of the cleaning and disinfecting fluids.

Yet another object of this invention is to supply a system that can be used on bare feet as well as footwear.

A further object of this invention is to supply a system that will automatically mix a cleaning agent or disinfecting fluid with water for the desired cleansing or disinfecting operation.

A still further object of this invention is to supply a portable system that can be used at a remote location with a fluid container and a waste recovery container.

Yet another object of this invention is to supply a system that can be used in an indoor environment using the fluid container and waste recovery container.

Another object of this invention is to supply a system that can be used in medical facilities to disinfect the shoes of medical personnel.

An additional object of this invention is to supply a system that can be used on farms for agriculture or animal raising and disinfect the shoes of workers to prevent the spread of diseases to crops and animals.

Still another object of this invention is to supply a system with easily replaceable parts.

In addition, another object of this invention is to supply a system that can be attached to a hot water source and heating elements for removing snow and ice from footwear.

A final object of this invention is to supply a system that will aide controlling the advancement of potential health problems like the bird flu.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

This invention provides a unique system that can be used to clean and disinfect the shoes worn by a person along with being capable of cleaning and disinfecting the feet and legs of a person not wearing shoes. Further, the device being automatically activated can be employed for the feet of livestock to reduce the potential health hazards carried by their feet. The system being adapted such that it will automatically activate when a person steps on the cleaning and disinfecting surface, and deactivate when the person steps off, provides for disinfecting of people without the need for them to remember to turn it on. Cleaning is provided when a person moves their feet back and forth over a wet brush section, for a brushing and fluid application, or scrapes their feet on either side of the wet brush section.

Additional utility for cleaning and disinfecting is provided by a brushing wand which is also supplied in the preferred mode of the device but could be eliminated in a mode of the device with great utility but slightly less function. The brushing wand may be employed to brush the top and sides of the footwear or the top of the bare feet and legs of the individual using the system. Further, in areas of snow, ice, and mud, the wand may be employed to cleanse the tops of footwear that may be covered with mud, ice, or snow.

The system consists of a mainframe assembly that may be inserted into a waste recovery tray component, or into a formed recovery component of concrete with an appropriate communicating drain system. The mainframe holding the major components of the shoe and foot cleaning and disinfecting system may easily be disassembled for transport and shipping thereby increasing potential use. A series of removable support bars that extend across the mainframe will disperse the weight of a person standing on the rubber mat and the rubber mat backing plate.

In the center of the mainframe is the wet brush section with a series of wet brush manifolds attached to two support bars which in the preferred mode are removable. Each wet brush manifold has one or more brush head units having a plurality of receiving orifices for insertion of removable bristle brush components. In the center of the brush head unit is a flexible tube with a removable nozzle end.

The wet brush units, engaged in an elevated position over the mainframe, are positioned for a registered engagement and to extend through orifices in the rubber mat and backing plate which are also supported above the bottom surface of the mainframe. By elongating the brush units to extend beyond the surface of the rubber mats, a direct contact with the sole of the footwear or bare feet of the individual using the system can be made to increase cleaning. The wet brush manifolds are interconnected by the means of a fluid supply tube which communicates fluid to the wet brush manifolds from a pressurized source for fluid when activated to do so by a fluid control unit.

It must be understood that a smaller shoe and foot cleaning and disinfecting system could be assembled with the wet brush sections on the side, or larger units may be assembled with two or more wet brush sections in differing positions, and still remain within the scope of this patent. The fluid control unit supplies fluid for cleansing and/or disinfecting from a pressurized fluid source to the wet brush section while concurrently communicating a fluid stream to one or more waste recovery tray cleaning jets in the front and back of the system. This fluid is supplied to the front cleaning jets by the means of a tube connecting the fluid control unit to a manifold section in the front of the main frame.

A means to recover, store, and dispose of debris collected in the waste recovery tray is provided by slanting the floor of the waste recovery tray in a slope which descends to the rear or one end of the tray where debris and waste fluid is removed through communication with a discharge orifice. This movement may be augmented by the means of additional cleaning jets on the elevated side of the recovery tray which will of course provide a fluid stream down the slope to the discharge orifice.

The fluid control unit which receives and communicates the pressurized fluid has an additional port on a top surface that is accessible by the user. The port on or near the top surface is adapted for the engagement of a brushing wand that may have a separate flow control leaver to control the fluid communicated from the port and dispensed by the distal end of the brushing wand. An optional elevated rail depicted as a "T" handle may also be provided as a means to help a user to maintain their balance while lifting a foot for cleaning by the wand or on the brushes, and also as a mount for the brushing wand when it is not in use. A removable backsplash plate may also be provided and is held in place by support members that extend through the orifices in the rubber mat and the backing plate.

At the top of the fluid control unit protruding from the rear channel member is a flow control knob to control the volume of fluid required for operation and the individual task at hand. More fluid may be required for a particularly dirty or muddy shoe while less may be desirable for a foot or relatively clean shoe which just needs disinfecting. An additional tubular member may be attached to the fluid control unit which creates a venturi suction to add the capability of mixing a detergent or disinfecting substance to a pressurized fluid or water source employed for the cleaning and disinfecting process.

One preferred method of operation for the shoe and foot cleaning and disinfecting system will employ a direct connection to a pressurized water source such as conventional plumbing with pressurized water from a well or city supply. Using the venturi component, the cleaning and disinfecting solutions are drawn in through the venturi suction line for use in cleaning and disinfecting, whereafter they are collected in the waste recovery tray subsequently draining to an appropriate drain connection.

A second preferred embodiment for the shoe and foot cleaning and disinfecting system would be to have the system connected to a reservoir container of fluid or water communicating with an on-demand pump powered by AC current or battery power. Using this mode of the device, the cleaning and disinfecting fluid can be premixed or housed in separate reservoir containers for engagement to the pump as they are depleted, and the waste recovery tray collecting the dispensed liquid draining to an appropriate drain connection. The premixed containers would be especially useful if there is no local water supply to engage or if the disease or contaminant being treated requires different rinses to obliterate. The plurality of containers in this instance can contain a plurality of fluid mixtures each adapted to be used in a sequence to clean and decontaminate feet and footwear.

Yet another preferred embodiment yielding a third mode of operation for the shoe and foot cleaning and disinfecting system is to have the system connected to two containers used as both a reservoir and collection container. In this mode of the device, a reservoir container containing the cleaning fluid would be engaged to an on-demand pump. The second container functioning as a collection container is mounted on the bottom of the fluid supply container and in communication with a vacuum pump. With the tanks so stacked, when the device is activated, the vacuum unit engages the lower tank creating a vacuum which draws water and debris from the waste recovery tray through a vinyl hose into the collection container. The reservoir container would concurrently supply fluid under pressure to the device which would be collected into the collection container once used. The tanks can be stored at a remote location by using longer hoses.

Another embodiment for method of operation for the shoe and foot cleaning and disinfecting system is employed where the footwear or feet are not dirty but require a disinfecting fluid to be applied. In this situation, the system will be connected to a single container of disinfecting fluid which would be disbursed under pressure from a pump, and collected into the same container from the collection tray. In this fashion, the fluid may be reused until its effectiveness has been depleted. This application could be used in a medical facility where the personnel could disinfect the bottoms of their feet and then wipe them on a disposable towel. This type of operation can greatly extend the capabilities of a small amount of disinfecting fluid.

An additional method of operation for the shoe and foot cleaning and disinfecting system would provide a heating element and a connection to a hot water supply line for the removal of snow and ice from footwear. With this operation mode and construction, the waste recovery could most likely be drained out on the ground or to an appropriate drain connection since only mud, snow, and ice are being washed from the footwear and the resulting waste fluid is not harmful to the environment.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
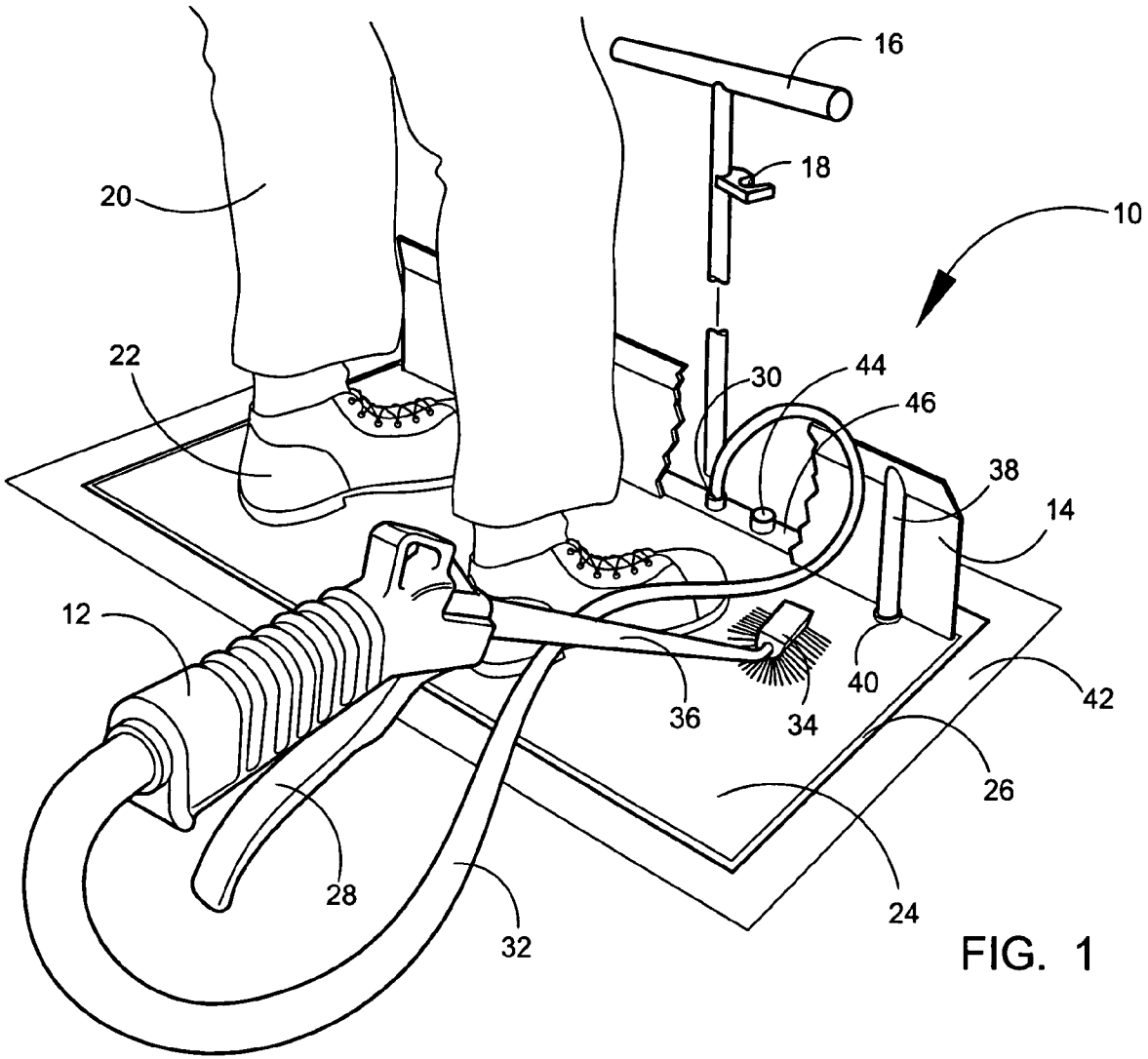
FIG. 1 depicts a perspective view of the shoe and foot cleaning and disinfecting system with the brushing wand, backsplash plate and "T" support handle.

Referring now to the drawings 1-8, wherein similar parts of the invention are identified by like reference numerals, there is seen in FIG. 1 a perspective view of the shoe and foot cleaning and disinfecting system 10 with the brushing wand 12, backsplash plate 14 and "T" support handle 16 with brush wand bracket 18. As noted above, the wand 12 and handle 16 and backsplash plate 14 make the device more functional and provide more utility to the user. However, a somewhat Spartan mode of the system 10 could be provided without one or more of these components and still provide utility in foot and footwear cleaning and disinfecting that is currently not available.

A person 20 is shown standing on the system 10 in FIG. 1. Their shoes 22 are depicted supported on top of the rubber mat 24 positioned over the mainframe assembly 26. The brush wand 12 is equipped with a fluid control lever 28 and is removably connected to the fluid access port 30 by the means of a flexible hose 32. A brush head 34 is at the end of the shaft 36 of the brush wand 12. The backsplash plate 14 is held in position substantially normal to the rubber mat 24 by means for engagement such as support members 38 extending through orifices 40 in the rubber mat 24. The shoe and foot cleaning and disinfecting system 10 as shown in FIG. 1 is depicted employing a built-in concrete enclosure 42 in place of the recovery tray 48 shown in the other modes of the system 10. The fluid control knob 44 is shown next to the wand-engageable fluid access port 30 on the rear channel member 46 of the mainframe assembly 26.

Figure 2:
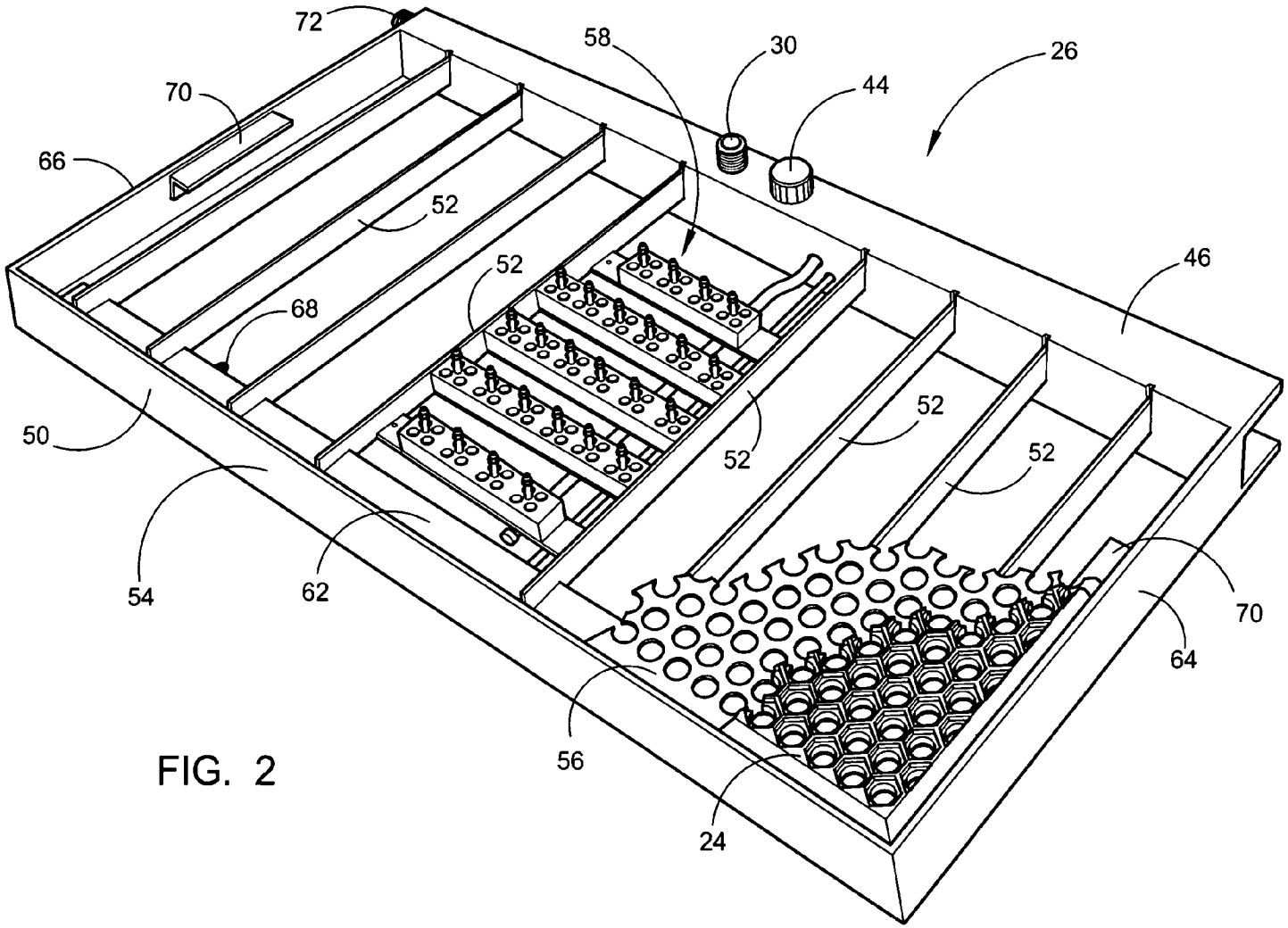
FIG. 2 depicts a perspective view of the mainframe assembly of the shoe and foot cleaning and disinfecting system.

The system consists of a mainframe assembly 26 shown in FIG. 2 dimensioned for engagement within a waste recovery tray 48 or into a concrete enclosure 42 with an appropriate drain system. The mainframe 50 holding the major components of the shoe and foot cleaning and disinfecting system 10 may easily be disassembled thereby providing for easy shipment and storage. The mainframe 50 features a series of support bars 52 that extend across the mainframe 50 from the rear channel member 46 to the front mainframe member 54. The support bars 52 are adapted to support and disperse the weight of a person standing on the rubber mat 24 which has means of support on top of the support bars 52 provided by rubber mat backing plate 56. Of course other means for support of the mat 24 might be employed; however, the current best mode of the system 10 employs the backing plate 56 having apertures 40 which align with apertures 40 in the rubber mat 24 when in a mounted engagement supported on the support bars 52. This aligned engagement allows for an uninterrupted passage of the brush components 78 to allow their distal ends to project above the mat 24. In a central portion of the mainframe 50 is the wet brush section 58 with a series of wet brush manifolds 60 attached to two of the removable support bars 52. The front manifold unit 62 extends from the right side member 64 of the mainframe 50 to the left side member 66 incorporating one or more jet nozzles 68 to flush the lower surface 98 of the waste recovery tray 48. A rubber mat 24 and rubber mat backing plate 56 support angle bracket 70 is attached to the mainframe 50 left and right side members 64 and 66. The primary fluid access port 72 is at the left end of the rear channel member 46.

Figure 3:
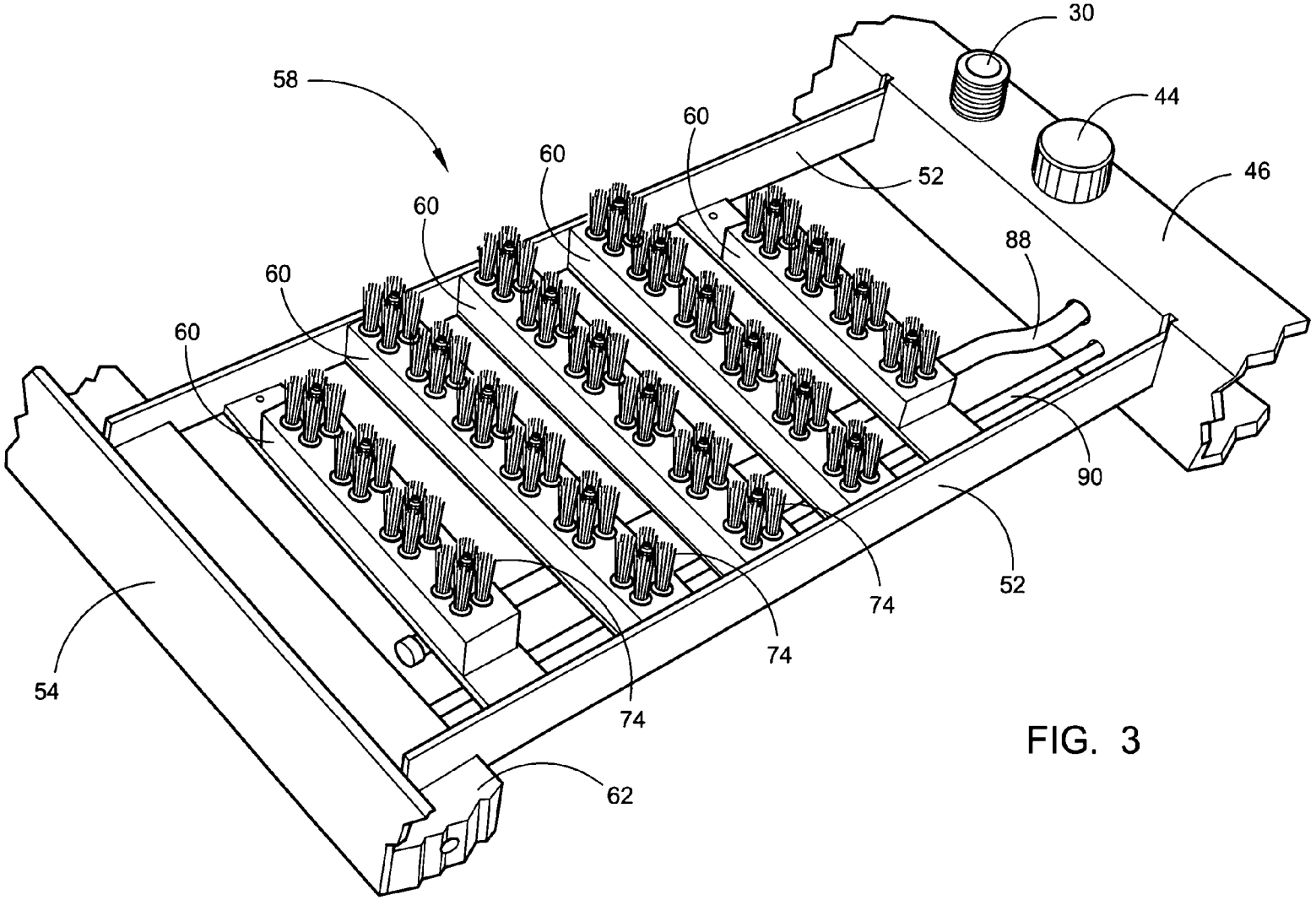
FIG. 3 depicts a perspective view of the wet brush area of the shoe and foot cleaning and disinfecting system.
Figure 4:
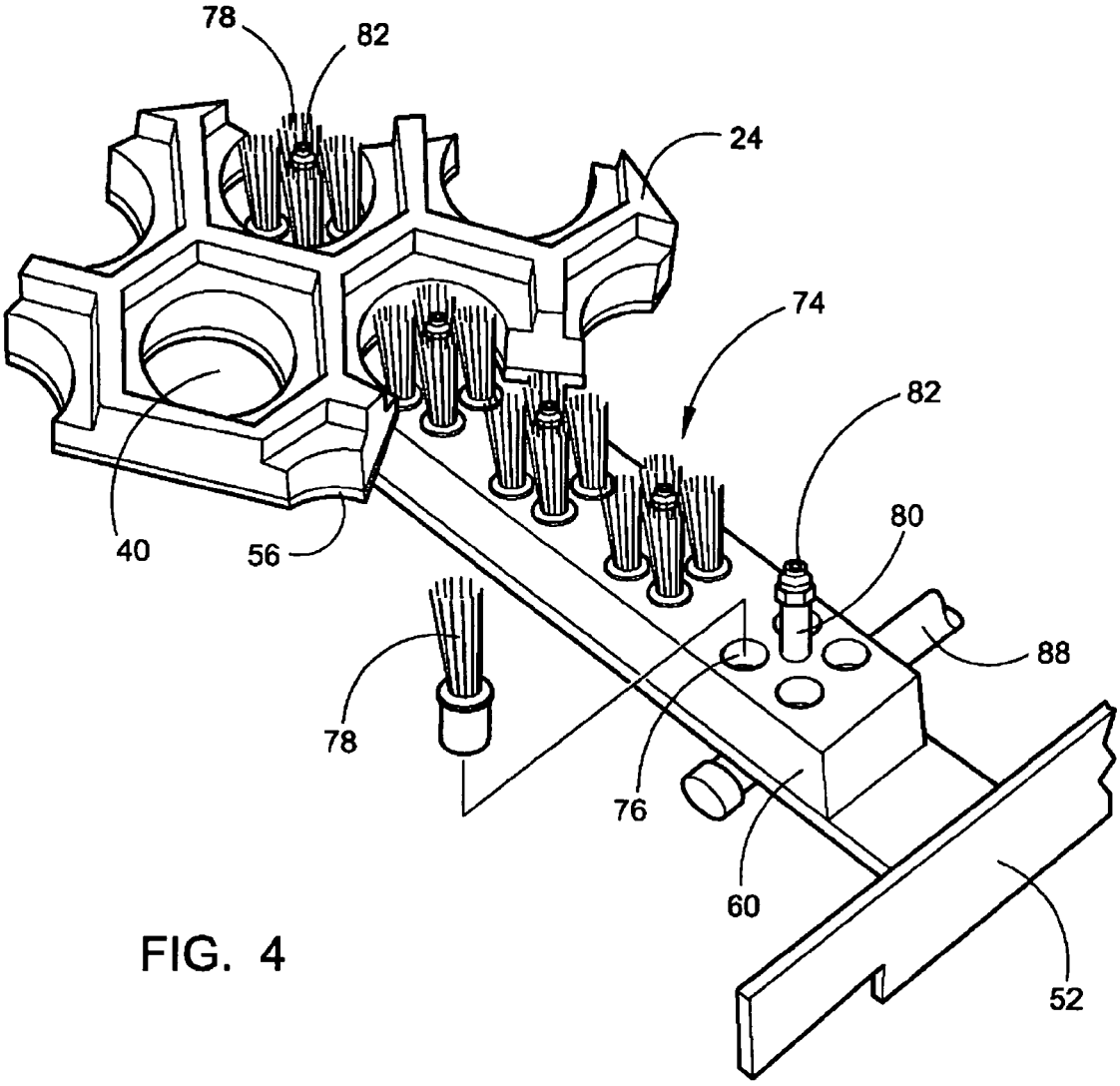
FIG. 4 depicts a perspective view of a single manifold section of the wet brush area with the replaceable brush head.

Each wet brush manifold 60 shown in FIG. 3 has one or more brush head units 74 having a plurality of orifices 76 in which to insert bristle brush components 78. A favored embodiment employs four such orifices 76. In the center of each brush head unit 74 is a flexible tube 80 with nozzle end 82 which is preferably removable for replacement if needed. The wet brush units 74 and flexible tubes 80 extend a length from the top of the brush manifold 60 sufficient to extend through orifices 40 in the rubber mat 24 and backing plate 56 and project above the top surface of the rubber mat 24. This relationship is clarified in FIG. 4 where a single bristle brush component 78 is depicted removed from one of the orifices 76 in the wet brush manifold 60 and the brush components 78 and flexible tube 80 extends the distance sufficient to project above the top of the rubber mat 24. This projection above the mat 24 is especially important to the function of the system properly as it allows the user a means for abrasive engagement of the bristles of the brush components 78 by sliding their feet or shoes across the top surface of the rubber mat 24. This contact helps remove dirt and grime especially from the depressions and cracks found in modern shoe soles.

Figure 5:
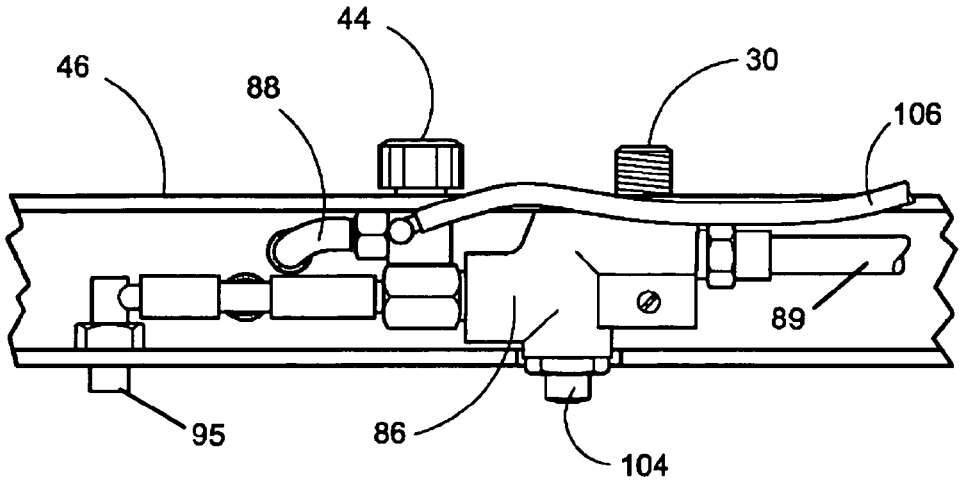
FIG. 5 depicts a side view of the fluid control unit.
Figure 6:
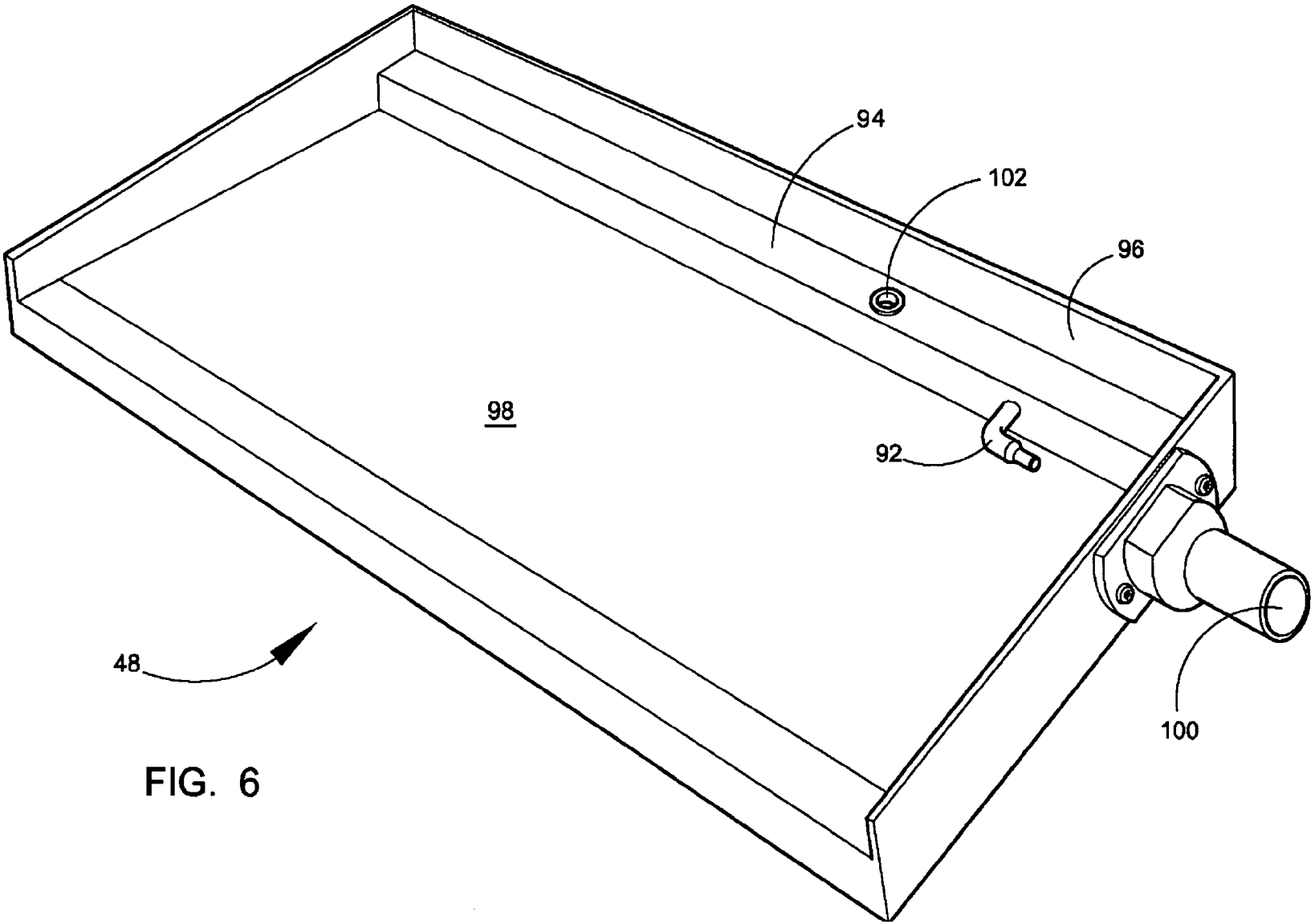
FIG. 6 depicts a perspective view of the waste recovery tray.

The wet brush manifolds 60 are interconnected by the means of a fluid supply line 88 that extends through the rear channel member 46 of the main frame 50 and to the fluid control unit 86 as shown in a side view in FIG. 5. Incoming pressurized fluid is provided to the system through control unit 86 from primary fluid supply line 89. The secondary fluid supply line 90 connects the front manifold unit 62 to the fluid control unit 86. The fluid control unit 86, when activated by means of the pressure generated by the weight of a person on the main frame 50, communicates fluid from the primary fluid supply line 89 to the wet brush section 58 along with supplying fluid to one or more waste recovery tray cleaning jets 68 and 92 in the front and back of the system.

This fluid is supplied to the front manifold unit 62 attached to front mainframe member 54 by the means of the secondary fluid supply line 90 and to the rear manifold unit 94, adjacent to the waste recovery tray rear wall 96 through fluid supply nipple 95 in cooperative sealed engagement using sealing means such as rubber bushing 102. The rear cleaning jet 92 is communicated a fluid supply from the rear manifold unit 94 to which it is engaged.

In a particularly preferred mode of the system 10, the lower surface 98 of the waste recovery tray 48 slopes to one side such as the rear as depicted, where debris and waste fluid are moved toward the discharge orifice 100 by the means of rear cleaning jets 92 directing a fluid stream to urge the discharge into and through the orifice 100. An orifice with a rubber bushing 102 is a direct connection between the fluid control unit 86 and the rear manifold unit 94.

A spring loaded or otherwise biased switching means such as button 104 at the bottom of the fluid control unit extends through the rear channel member to make contact with the top of the rear manifold unit 94. The button 104 in contact with the rear manifold unit 94 thereby provides a means of activation of the fluid control unit 86 to communicate pressurized fluid through the system 10 as described. The biased bottom 104 or other means to activate the fluid control unit 86 to communicate fluid using the weight of a person standing on the device works best as it requires no actual switching by the user to initiate fluid flow through the complete system. An additional tubular member 106 is operatively attached to the fluid control unit 86 providing a venturi suction and means to inject or mix a detergent or disinfecting substance into the disbursed fluid or water source during the cleaning and disinfecting process when the control unit 86 is activated by a user's weight to communicate pressurized fluid to the system components.

Figure 7:
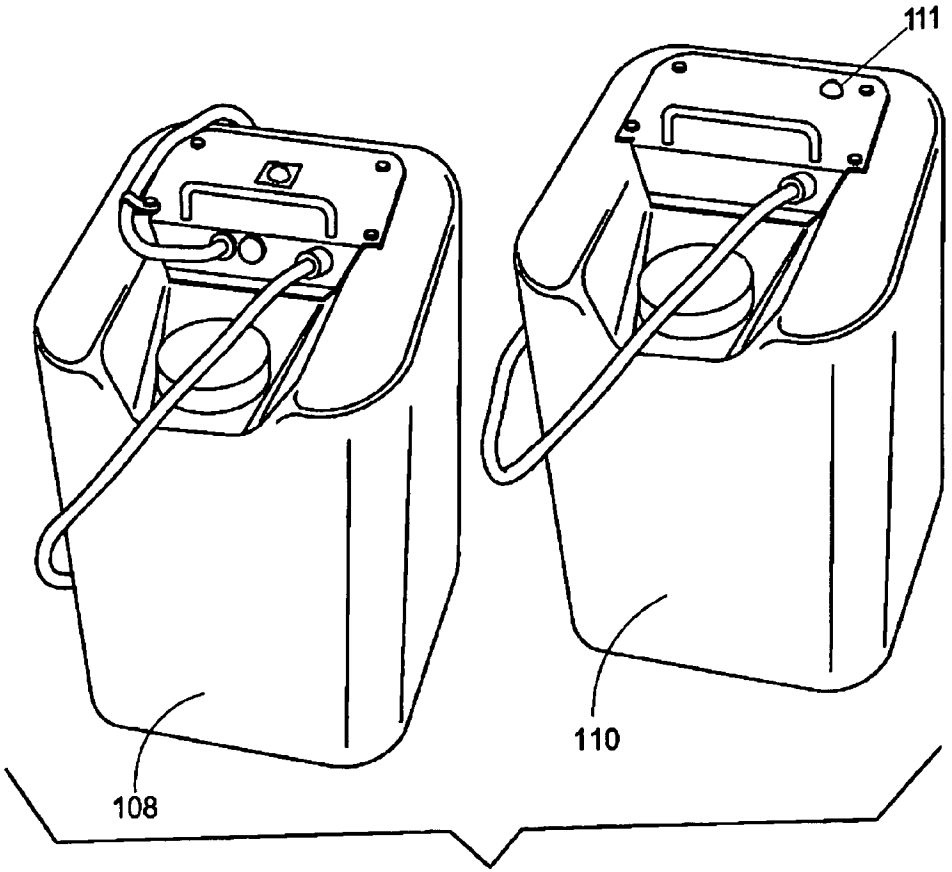
FIG. 7 depicts a perspective view of the fluid supply container and the waste recovery container.

FIG. 7 depicts a perspective view of a fluid supply container 108 providing a reservoir for fluid to be disbursed, and the waste recovery container 110. The waste recovery container 110 can be used for storage of depleted or dirty cleaning and disinfecting fluid when appropriate drainage is not available and a vacuum engagement fitting 111 is provided for optional sealed engagement with a vacuum pump or other means to draw a vacuum.

Figure 8:
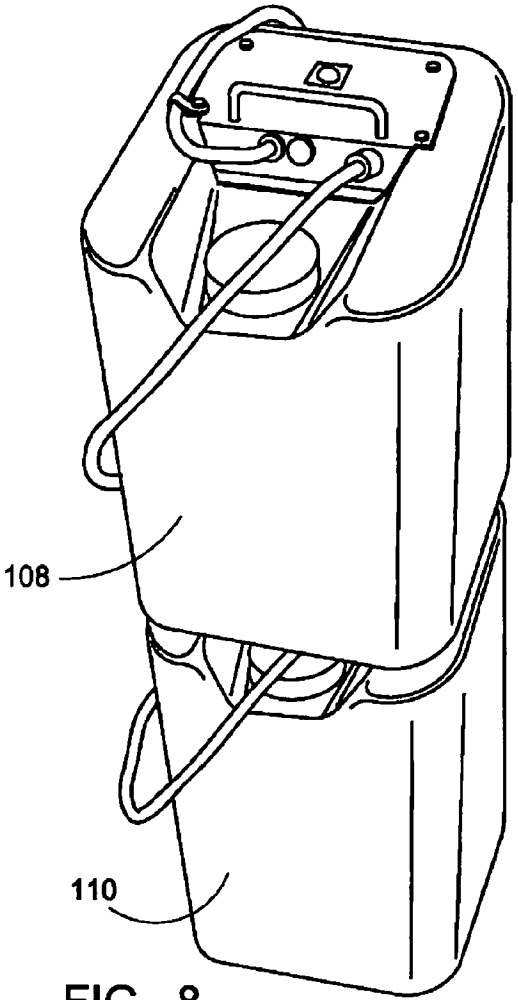
FIG. 8 depicts a perspective view of the fluid supply container and the waste recovery container in a stacked configuration.

FIG. 8 depicts a perspective view of the fluid supply container 108 and the waste recovery container 110 in a stacked configuration which is accomplished by adapting the bottom of fluid supply container 108 to engage upon the top of waste recovery container 110. Providing this adaptation of the two containers for this stacked arrangement is especially preferred as it provides for a small footprint for the reservoir and storage components. Additionally, by placing the reservoir above the storage tank recovery container 110 and much higher than the system components, the system 10 employing this elevated reservoir can function without a pump since the fluid from the elevated reservoir supply container 108 will naturally flow downhill to primary fluid supply line 89.

The shoe and foot cleaning and disinfecting system 10 shown in the drawings and described in detail herein disclose arrangements of elements of particular construction and configuration for illustrating preferred embodiments of structure and method of operation of the present invention. It is to be understood, however, that elements of different construction and configuration and other arrangements thereof, other than those illustrated and described may be employed for providing a shoe and foot cleaning and disinfecting system 10 in accordance with the spirit of this invention, and such changes, alternations and modifications as would occur to those skilled in the art are considered to be within the scope of this invention as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology to determine quickly from a cursory inspection the nature and essence of the technical disclosure of the application. The abstract is neither intended to define the invention of the application, which is measured by the claims, nor is it intended to be limiting as to the scope of the invention in any way

What is claimed is:

1. A footwear and foot cleaning and disinfecting apparatus comprising:

a mainframe having a top surface, a bottom surface, and a perimeter edge defined by parallel first and second edges connected by side edges;

a planar support surface having an upper surface separated from a parallel lower surface by a width of said support surface, and having a circumference defining exterior dimensions of said support surface;

a plurality of apertures communicating between the upper surface and the lower surface;

said lower surface of said support surface engageable on said top surface of said mainframe;

a fluid control unit communicating with a supply of pressurized fluid, said fluid control unit having an activated state wherein said pressurized fluid is communicated from an output aperture, and having a default deactivated state interrupting said communication;

a plurality of bristle assemblies engaged in a central area of said mainframe;

each bristle assembly having bristles extending a distance above said top surface of said mainframe and having a flexible conduit adjacent to said bristles extending substantially said distance above said top surface;

said flexible conduit having a first end in sealed engagement to a fluid supply conduit communicating with said output aperture, and having a distal end adapted for fluid disbursement;

said distance being larger than said width of said support surface thereby providing a projection of said bristle assembly above said top surface;

said mainframe dimensioned for engagement with a recovery tray above a bottom surface of said tray which is surrounded by sidewalls;

means to change said fluid control unit to said activated state only when weight is placed upon said upper surface;

a disbursement of said fluid from said distal ends of said flexible conduits during said activated state, whereby a user standing on said upper surface will activate said apparatus and can employ said bristles and said fluid to clean their footwear or feet and dislodge debris using said bristles and said fluid disbursed from said flexible conduits.

2. The footwear and foot cleaning and disinfecting apparatus of claim 1 additionally comprising:

said recovery tray having a drain communicating through said one of said bottom surface or said sidewall;

said drain communicating with an exit conduit; and said exit conduit providing a path for removal of said fluid and said debris collecting in said tray during said activated state.

3. The footwear and foot cleaning and disinfecting apparatus of claim 2 additionally comprising:

said bottom surface being slanted from a higher end toward a lower end adjacent to said drain thereby providing means to enhance communication of said fluid and said debris into said exit conduit.

4. The footwear and foot cleaning and disinfecting apparatus of claim 3 additionally comprising:

a cleaning jet having a first end communicating with said fluid supply conduit and a distal end adapted to discharge said fluid; and said cleaning jet positioned to discharge said fluid adjacent to said drain during said activated state thereby providing means to enhance communication of said debris into said exit conduit.

5. The footwear and foot cleaning and disinfecting apparatus of claim 3 additionally comprising:

at least one cleaning nozzle having a first end communicating with said fluid supply conduit and a distal end adapted to discharge said fluid; and said cleaning nozzle positioned to discharge said fluid at said higher end of said bottom surface, thereby providing means to enhance communication of said debris from said higher surface to said lower surface and into said exit conduit.

6. The footwear and foot cleaning and disinfecting apparatus of claim 4 additionally comprising:

at least one cleaning nozzle having a first end communicating with said fluid supply conduit and a distal end adapted to discharge said fluid; and said cleaning nozzle positioned to discharge said fluid at said higher end of said bottom surface, thereby providing means to enhance communication of said debris from said higher surface to said lower surface and into said exit conduit.

7. The footwear and foot cleaning and disinfecting apparatus of claim 1 wherein said mainframe engagement with said recovery tray comprises:

said recovery tray having a first ledge and second ledge, both positioned above said bottom surface;

said perimeter edge of said mainframe sized to fit in-between said sidewalls rising said recovery tray adjacent to said first edge and said side edges of said mainframe; and said first ledge and said second ledge providing supports under said first edge and said second edge of said mainframe.

8. The footwear and foot cleaning and disinfecting apparatus of claim 3 wherein said mainframe engagement with said recovery tray comprises:

said recovery tray having a first ledge and second ledge, both positioned above said bottom surface;

said perimeter edge of said mainframe sized to fit in-between said sidewalls rising said recovery tray adjacent to said first edge and said side edges of said mainframe; and said first ledge and said second ledge providing supports under said first edge and said second edge of said mainframe.

9. The footwear and foot cleaning and disinfecting apparatus of claim 6 wherein said mainframe engagement with said recovery tray comprises:

said recovery tray having a first ledge and second ledge, both positioned above said bottom surface;

said perimeter edge of said mainframe sized to fit in-between said sidewalls rising said recovery tray adjacent to said first edge and said side edges of said mainframe; and said first ledge and said second ledge providing supports under said first edge and said second edge of said mainframe.

10. The footwear and foot cleaning and disinfecting apparatus of claim 6 wherein said means to change said fluid control unit to said activated state only when weight is placed upon said upper surface, comprises:

an activation button operationally engaged to said fluid control unit on a first end and projecting to a distal end;

said activation button biased to an extended position placing said fluid control unit in an inactivated state;

said activation button translatable to a depressed position, placing said fluid control unit in said activated state;

said activation button extending from said first edge of said mainframe to a contact of said distal end of said button with said first ledge of said tray;

said contact providing an elevation of said first edge of said mainframe above said first ledge when said button is biased to said extended position; and said button translating to said depressed position when weight from a user's foot forces said first edge of said mainframe toward said first ledge.

11. The footwear and foot cleaning and disinfecting apparatus of claim 7 wherein said means to change said fluid control unit to said activated state only when weight is placed upon said upper surface, comprises:

an activation button operationally engaged to said fluid control unit on a first end and projecting to a distal end;

said activation button biased to an extended position placing said fluid control unit in an inactivated state;

said activation button translatable to a depressed position, placing said fluid control unit in said activated state;

said activation button extending from said first edge of said mainframe to a contact of said distal end of said button with said first ledge of said tray;

said contact providing an elevation of said first edge of said mainframe above said first ledge when said button is biased to said extended position; and said button translating to said depressed position when weight from a user's foot forces said first edge of said mainframe toward said first ledge.

12. The footwear and foot cleaning and disinfecting apparatus of claim 8 wherein said means to change said fluid control unit to said activated state only when weight is placed upon said upper surface, comprises:

an activation button operationally engaged to said fluid control unit on a first end and projecting to a distal end;

said activation button biased to an extended position placing said fluid control unit in an inactivated state;

said activation button translatable to a depressed position, placing said fluid control unit in said activated state;

said activation button extending from said first edge of said mainframe to a contact of said distal end of said button with said first ledge of said tray;

said contact providing an elevation of said first edge of said mainframe above said first ledge when said button is biased to said extended position; and said button translating to said depressed position when weight from a user's foot forces said first edge of said mainframe toward said first ledge.

13. The footwear and foot cleaning and disinfecting apparatus of claim 1 additionally comprising:

a venturi communicating with said supply conduit at an input end and having an intake end adapted for engagement to a supply tube from an additive reservoir;

said additive reservoir holding one or a combination of detergent and disinfectant.

14. The footwear and foot cleaning and disinfecting apparatus of claim 10 additionally comprising:

a venturi communicating with said supply conduit at an input end and having an intake end adapted for engagement to a supply tube from an additive reservoir;

said additive reservoir holding one or a combination of detergent and disinfectant.

15. The footwear and foot cleaning and disinfecting apparatus of claim 3 wherein said supply of pressurized fluid communicating with said fluid control unit comprises:

a reservoir tank; and a pump communicating with fluid in said tank on an input conduit and providing said pressurized fluid from an output conduit in operative communication with said fluid control unit.

16. The footwear and foot cleaning and disinfecting apparatus of claim 15 additionally comprising:

a collection tank in sealed communication with said exit conduit from said drain; and means to create negative air pressure in said collection tank whereby and said fluid and said debris communicated into said exit conduit are drawn into said collection tank by said negative air pressure.

17. The footwear and foot cleaning and disinfecting apparatus of claim 16 additionally comprising:

said collection tank having a top surface;

said top surface adapted for cooperative engagement with a bottom surface of said reservoir tank; and said reservoir tank engageable in an elevated position on top of said collection tank thereby creating a reduced footprint for said collection tank and reservoir tank and saving space.

18. The footwear and foot cleaning and disinfecting apparatus of claim 17 additionally comprising:

said elevated position of said reservoir tank providing means to generate fluid flow to said fluid control unit from a gravity feed.

19. The footwear and foot cleaning and disinfecting apparatus of claim 3 additionally comprising:

a cleaning wand having a handle end and a fluid discharge nozzle at a distal end;

a hose engaged between said handle end and said fluid supply conduit; and said cleaning wand providing means to direct said fluid to a top surface of a foot or footwear when said fluid control unit is in said activated state.

* * * * *